US006298554B1

(12) United States Patent
Fuchs

(10) Patent No.: US 6,298,554 B1
(45) Date of Patent: Oct. 9, 2001

(54) FLEXIBLE VENTED SELF-SEALING DISPENSING VALVE

(75) Inventor: Timothy J. Fuchs, Perrysburg, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/542,738

(22) Filed: Apr. 4, 2000

Related U.S. Application Data

(62) Division of application No. 09/053,709, filed on Apr. 2, 1998, now Pat. No. 6,062,436.

(51) Int. Cl.[7] ..... B21K 1/20

(52) U.S. Cl. ..... 29/890.127; 29/890.124; 264/296; 264/328.2

(58) Field of Search ..... 222/212, 482, 222/490, 494; 137/844, 845, 846; 264/294, 296, 328.1, 328.2; 29/890.124, 890.126, 890.127, 527.1

(56) References Cited

U.S. PATENT DOCUMENTS

| | | | | |
|---|---|---|---|---|
| 1,206,661 | | 11/1916 | Booth . | |
| 2,175,052 | | 10/1939 | Bull et al. . | |
| 2,292,373 | | 8/1942 | Groeniger . | |
| 2,644,663 | | 7/1953 | Klingler . | |
| 2,667,992 | | 2/1954 | Hammond et al. . | |
| 3,773,233 | | 11/1973 | Souza . | |
| 3,822,720 | | 7/1974 | Souza . | |
| 3,941,149 | | 3/1976 | Mittleman . | |
| 4,143,853 | | 3/1979 | Abramson . | |
| 4,209,485 | * | 6/1980 | Greenspan | 222/494 |
| 4,341,239 | | 7/1982 | Atkinson . | |
| 4,474,314 | * | 10/1984 | Roggenburg, Jr. | 222/294 |
| 4,646,945 | | 3/1987 | Steiner et al. . | |
| 5,005,737 | | 4/1991 | Rohr . | |
| 5,115,950 | | 5/1992 | Rohr . | |
| 5,301,707 | | 4/1994 | Hofsteenge . | |
| 5,339,995 | | 8/1994 | Brown et al. . | |
| 5,390,805 | | 2/1995 | Bilani et al. . | |
| 5,439,143 | | 8/1995 | Brown et al. . | |
| 5,472,122 | | 12/1995 | Appleby . | |
| 5,655,687 | | 8/1997 | Fitten et al. . | |
| 5,842,618 | | 12/1998 | Julemont et al. . | |
| 6,045,004 | * | 4/2000 | Elliott | 222/494 |
| 6,050,435 | * | 4/2000 | Bush et al. | 222/494 |
| 6,112,951 | * | 9/2000 | Mueller | 222/494 |

FOREIGN PATENT DOCUMENTS

| | | | |
|---|---|---|---|
| 19612561 | | 9/1997 | (DE) . |
| 19640629 | | 4/1998 | (DE) . |
| 0495440 | | 7/1992 | (EP) . |
| 549015A1 | * | 6/1993 | (EP) . |
| 555623A1 | * | 8/1993 | (EP) . |
| 9910247 | | 3/1999 | (WO) . |

* cited by examiner

*Primary Examiner*—I Cuda Rosenbaum
*Assistant Examiner*—T. Nguyen

(57) ABSTRACT

A method of manufacturing a squeeze-type container package that comprises a flexible resilient container body and a self-sealing closure assembly mounted to the mouth of the container body. The self-sealing closure assembly includes a dispensing valve of one-piece integrally molded elastic construction having an annular base, an internal wall portion that extends radially inwardly and axially from the base, and a mouth portion that includes a slit opening oriented diametrically of the annular base. Internal stresses within the wall portion bias the slit to the closed position. An annular lip that extends radially outwardly from the valve cooperates with an annular internal rib on the closure for venting the interior of the container body to atmosphere when the container body is released following dispensing of product.

10 Claims, 3 Drawing Sheets

FLEXIBLE VENTED SELF-SEALING DISPENSING VALVE

This is a division of application Ser. No. 09/053,709 filed Apr. 2, 1998 now Pat. No. 6,062,436

The present invention is directed to a self-sealing closure assembly for a resilient squeeze-type container package, and more particularly to self-sealing valve and method of construction for such an assembly.

BACKGROUND AND SUMMARY OF THE INVENTION

It has heretofore been proposed to provide a squeeze-type container package for dispensing viscous products, such as toothpaste, that includes a resilient self-closing valve mounted on a closure assembly at the container mouth. The valve is of resilient elastomeric composition, and includes a dispensing opening that is normally closed by internal resiliency of the valve material. When the flexible container is 0 squeezed to dispense product, internal pressure forces the product through the valve opening. When the container is released, negative pressure within the container retracts the product at the container opening, so that the valve opening is closed both by the negative pressure of retracting product and internal resiliency of the valve material. In valves of this type of conventional design, it is typically necessary to cut the dispensing opening in the valve in a secondary operation after molding of the valve body.

It is a general object of the present invention to provide a self-closing valve of the described character, and a method of fabrication, in which the dispensing opening is fabricated in the valve during molding of the valve body in a unitary integrally molded construction, and thus does not require a secondary operation to form the dispensing opening. Another object of the present invention is to provide a valve and method of construction of the described character in which the valve cooperates with the closure when assembled to a squeeze-type dispensing package automatically to vent air into the package when the container body is released following a dispensing operation. Yet another of the present invention is to provide a self-closing valve, a method of fabrication, a valve and closure assembly, and a squeeze-type container package that achieve one or more of the foregoing objectives, and may be readily and inexpensively fabricated employing otherwise conventional technology.

A valve for a self-sealing dispensing closure in accordance with one aspect of the present invention takes the form of a one-piece construction of integrally molded elastic composition that has an annular base, an internal wall portion that extends radially and axially from the annular base, and a mouth portion that includes a slit oriented diametrically of the annular base. The wall portion of the valve is internally stressed for resiliently biasing the slit closed. A pair of lugs are provided on the wall portion of the valve diametrically opposed to each other and orthogonal to the slit opening on a side of the wall portion remote from the annular base, with the lugs being internally stressed for assisting the wall portion in resiliently biasing the slit opening to a closed position. Ribs on the mouth portion of the valve extend along each side of the slit opening, and are internally stressed for maintaining diametric orientation of the slit opening.

The valve is mounted in accordance with another aspect of the invention in a self-sealing closure assembly that includes a plastic closure shell having a central opening at which the slit opening of the valve is disposed. In accordance with a third aspect of the invention, the closure assembly is mounted on a resilient container body. The valve has a peripheral rib that extends radially outwardly from the annular base, which is captured by a basket within the closure against the base wall of the closure. A peripheral lip extends radially outwardly from the rib, and normally engages an annular internal rib on the base wall of the closure. When the resilient container is released following dispensing of product, negative pressure within the container pulls the lip from the annular rib on the closure, and the internal volume of the container is vented to atmosphere around the lip through a series of channels between the valve rib and the closure base, and through an opening in the basket that captures the valve against the closure base.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
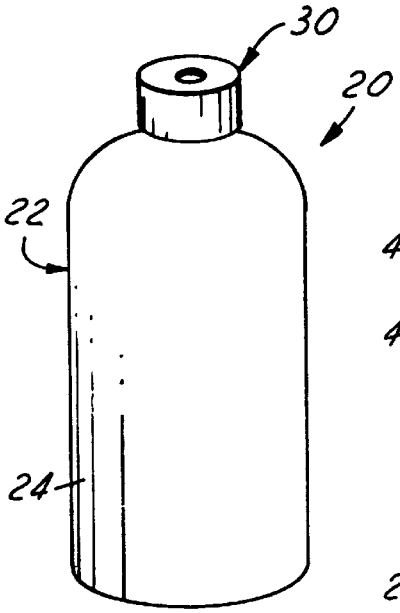
FIG. 1 is a perspective view of a closure and container package in accordance with a presently preferred embodiment of the invention.

FIG. 1 illustrates a squeeze-type container package 20 in accordance with one aspect of the present invention as comprising a container 22 of flexible resilient composition such as blow-molded plastic. Container 22 has a body 24 and an open mouth 26 surrounded by an externally threaded cylindrical finish 28. A closure assembly 30 is mounted to finish 28. Closure assembly 30 (FIGS. 1, 2, 4 and 5) includes a closure or overcap 32, a basket 34 mounted within closure 32, and a self-closing valve 36 captured by basket 34 within closure 32. Container 22 may be fabricated of any suitable material by any suitable technique, such as polypropylene or an extrusion/blow-molding operation.

Referring to FIGS. 4–7, closure 32 has a flat base wall 38 and a circumferentially continuous peripheral skirt 40. Skirt 40 includes suitable means for affixing closure 32 and closure assembly 30 to finish 28 of container 22, such as internal threads 42 (FIG. 2) for coupling with external threads 44 on the container finish A central opening 46 in closure base wall 38 provides for dispensing of product from within the container package. A shoulder 47 extends around the inside of closure 32 at the juncture of skirt 40 and the undersurface of base wall 38. Shoulder 47 has a radially inwardly extending lip 48 at controlled axial spacing from base wall 38, for purposes to be described. Closure 32 may be formed of any suitable material employing any suitable manufacturing technique, such as polypropylene fabricated in an injection molding operation.

Figure 8:
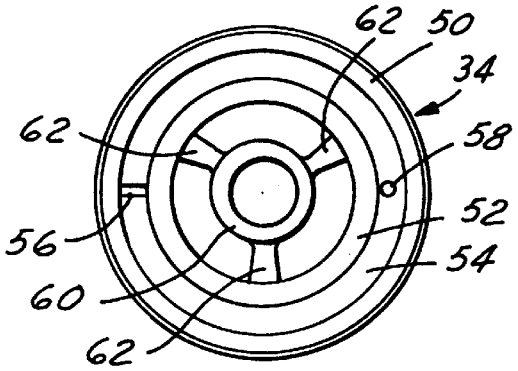
FIGS. 8 and 9 are top plan and side elevational views of the basket illustrated in FIG. 5.
Figure 9:
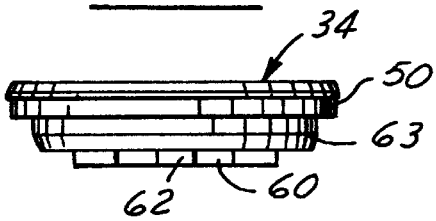

Basket 34 (FIGS. 5, 8 and 9) includes a cylindrical peripheral wall 50 from which a flat base 52 extends radially inwardly. A channel 54 is formed around the major portion of base 52 adjacent to wall 50, being interrupted by a radial rib 56. A through-opening 58 extends through base 52 within channel 54 at a position diametrically opposite rib 56. A cylindrical collar 60 is carried within base 52 by three angularly spaced radial spokes 62. The interior of collar 60 and the area exterior to collar 60 between spokes 62 are open for passage of product from within the container package. A skirt 63 depends from base 52 beneath channel 54 adjacent to wall 50. Peripheral wall 50 has an outwardly projecting ledge 61, from which wall 50 slopes radially inwardly to the axial end of basket 34. Basket 34 may be formed by suitable techniques and of suitable composition, such as polypropylene formed in an injection molding operation.

Figure 10:
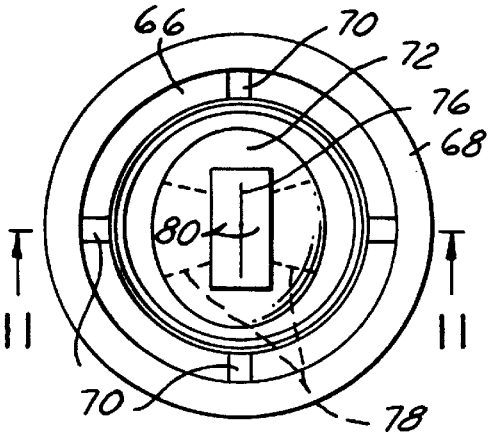
FIG. 10 is a top plan view of the self-closing valve in the assembly of FIGS. 4 and 5.
Figure 11:
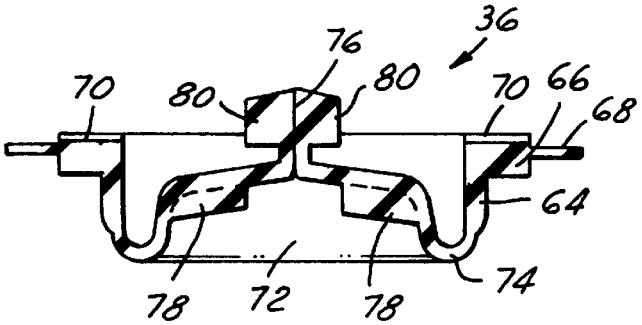
FIG. 11 is a sectional view taken substantially along the line 11—11 of FIG. 10.

Self-closing valve 36 is illustrated in greater detail in FIGS. 10 and 11. Valve 36 includes an annular circumferentially continuous base 64 that terminates at its upper end (in the orientation of FIGS. 2–3 and 10) in a radially outwardly extending circumferentially continuous rib 66. A circumferentially continuous lip 68 extends radially outwardly from rib 66, being positioned beneath the upper surface of rib 66 and of thinner and more resilient construction than the rib. Four radially oriented slots 70 extend along the upper surface of rib 66 at 90 degree spacing from each other. At the lower end of annular base 64, a wall portion 72 extends radially inwardly and axially upwardly, being coupled to the lower end of base 64 by the concave resilient wall portion 74. The inner end of wall portion 72 terminates in a slit opening 76 that extends diametrically of valve 36. The pair of circumferentially and radially extending lugs 78 are formed on the underside of wall portion 72. A pair of diametrically extending opposed ribs 80 are disposed on either side of slit opening 76. Valve 36 may be unitarily formed of suitable elastic plastic composition such as thermoplastic elastomer, preferably in an injection molding or other suitable operation.

Figure 12:
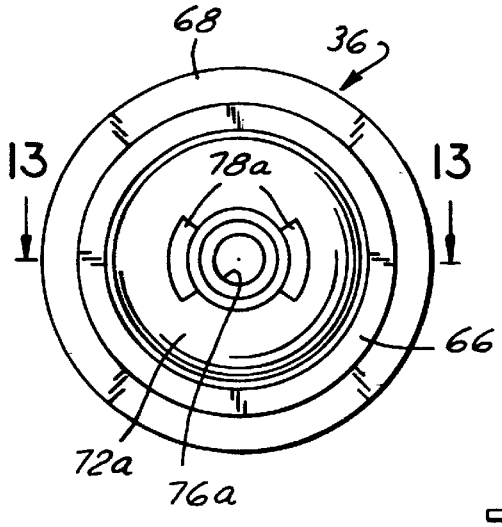
FIG. 12 is a bottom plan view of the valve illustrated in FIGS. 10 and 11 as fabricated.
Figure 13:
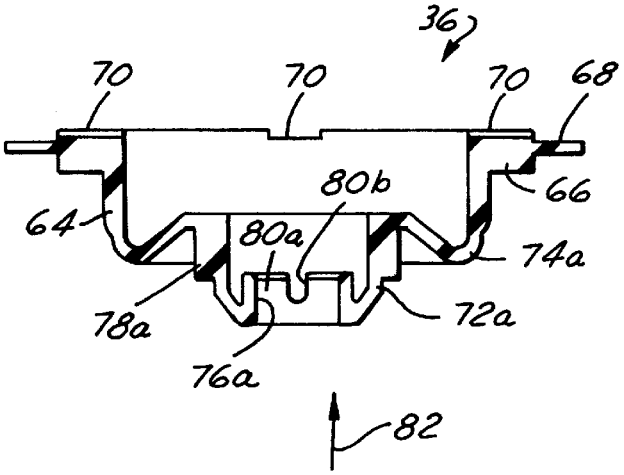
FIG. 13 is a sectional view taken substantially along the line 13—13 in FIG. 12.

FIGS. 12–13 illustrate valve 36 as initially formed. Elements in FIGS. 12–13 that are identical as formed and as used are indicated by correspondingly identical reference numerals, and elements that are re-oriented between formation and use are indicated in FIGS. 12–13 by corresponding reference numerals followed by the suffix "a." In the valve 36 as formed, wall portion 72*a* is initially cylindrical, and the integral ribs 78*a* extend axially along the outer surface of wall portion 72*a*. The inner edge of wall portion 72*a* terminates in a cylindrical mouth 76*a* that is surrounded a circumferential rib 80*a* that has diametrically opposed interruptions 80*b*. The as-formed configuration of valve 36 illustrated in FIGS. 12 and 13 preferably has no internal residual stresses, and is substantially stress-free in the configuration as shown. Following fabrication and cooling, the interior portion of valve 36, including wall portion 72*a* and ribs 80*a* forming cylindrical opening 76*a*, is inverted by being urged upwardly in the direction 82 in FIG. 13, so that wall portion 72*a* and opening 76*a* invert to the configuration illustrated in FIGS. 10 and 11. In this configuration, opening 76*a* assumes the configuration of a diametric slit 76. Internal stresses within wall portion 72 and lugs 78 hold slit 76 closed, while ribs 80 maintain the diametric orientation of the slit. These internal stresses tend to re-invert the valve; but such re-inversion is prevented by abutment at slit 76, and by basket 34 in assembly as will be described.

Figure 2:
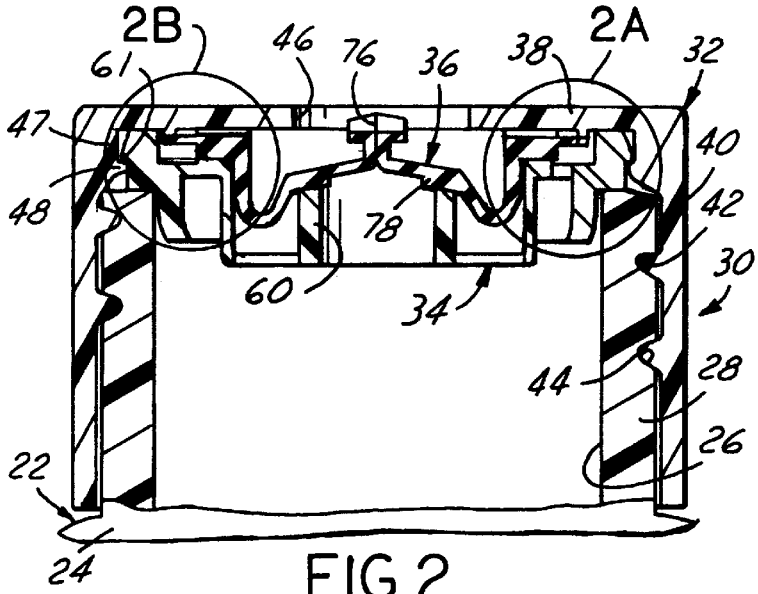
FIG. 2 is a fragmentary sectional view on an enlarged scale of the container finish and closure in the embodiment of FIG. 1.
Figure 2A:
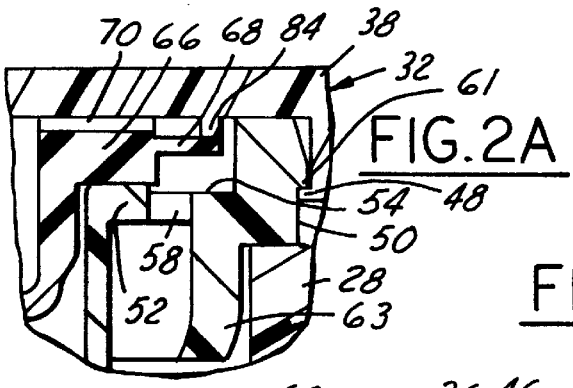
FIGS. 2A and 2B are fragmentary sectional views on an enlarged scale of the portions of FIG. 2 within the respective circles 2A and 2B.
Figure 2B:
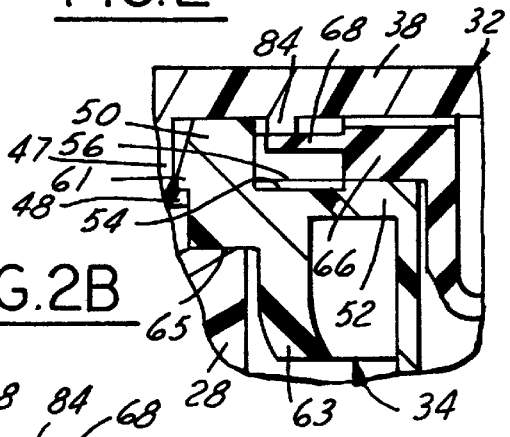
Figure 3:
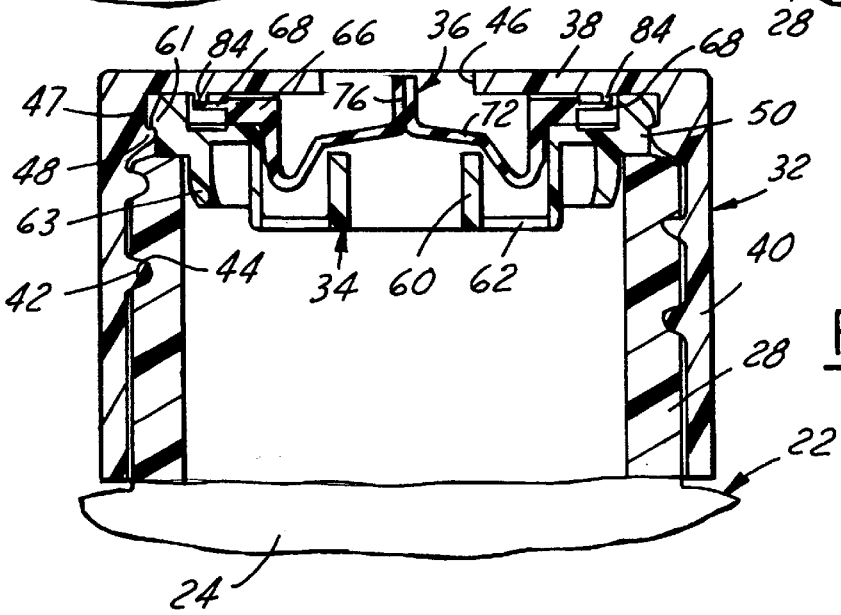
FIG. 3 is a sectional view similar to that of FIG. 2 but taken from a direction 90 degrees offset from that in FIG. 2.
Figure 4:
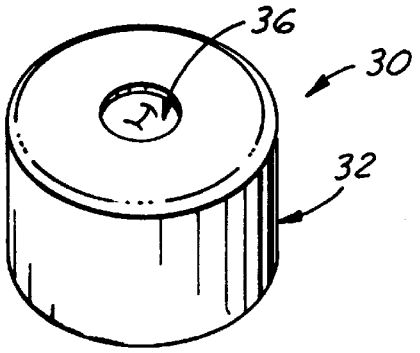
FIG. 4 is a perspective view of the closure assembly in the container package of FIG. 1.
Figure 6:
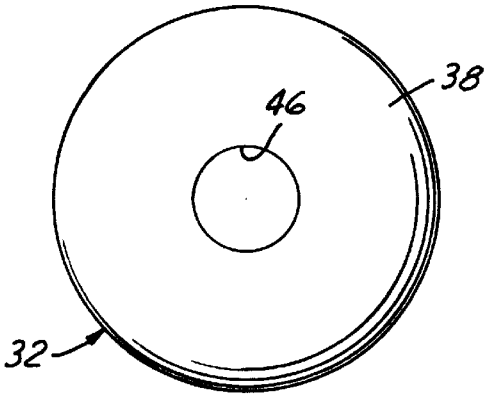
FIGS. 6 and 7 are top plan view and a side elevational view of the closure illustrated in FIGS. 4 and 5.
Figure 5:
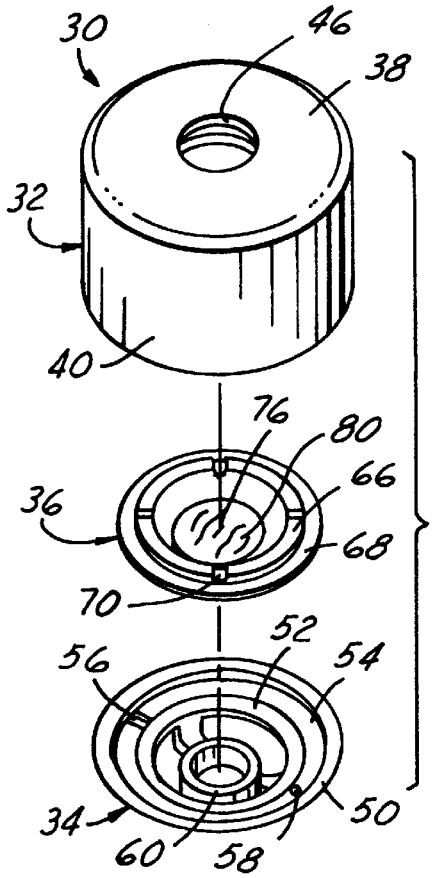
FIG. 5 is an exploded perspective view of the closure assembly illustrated in FIG. 4.
Figure 7:
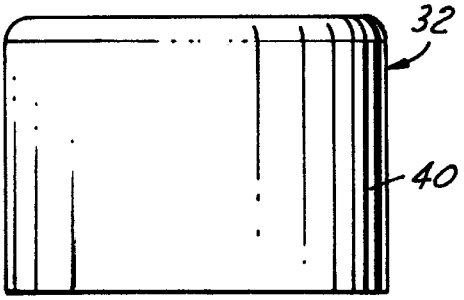

Referring now to FIGS. 2–3, valve 36 is captured in assembly between basket 34 and base wall 38 of closure 32. Specifically, valve 36 is placed on basket 34, and basket 34 is inserted into closure 30. When the sloping outer surface of wall 50 abuts lip 48 on shoulder 47, the shoulder is cammed radially outwardly until shoulder 61 snaps beneath lip 48. The spacing between lip 48 and base wall 38 is such as to hold basket 34 firmly in assembly. At this point, rib 66 on valve 36 is sandwiched in assembly between base 52 of basket 34 and the opposing internal surface of closure base wall 38. Lip 68 on valve 36 normally resiliently engages an annular internal rib 84 on closure base wall 38, and basket through-opening 58 (FIG. 2A) and basket rib 56 (FIG. 2B) underlie valve lip 68. Slots 70 on valve rib 66 cooperate with the opposing inner surface of valve base wall 38 to form radial passages for venting the interior of container 20, as will be described. Skirt 63 on basket 34 is disposed in assembly adjacent to the interior of container finish 28, with the axial shoulder 65 on wall 50 sealing against the upper edge of the container finish. The upper edge of basket collar 60 engages lugs 78 on valve 36 to support slit opening 76 within opening 46 of closure 32, and to prevent re-inversion of the valve under negative pressure when container 22 is released.

Closure assembly 30 is prefabricated, as is container 22. After container 22 is filled with product, closure assembly 30 is affixed to finish 28 of container 22. The packager who fills and caps the container is usually different from the party or parties who fabricate the container and the closure assembly. In this connection, closure assembly 30, including closure 32, basket 34 and valve 36, may be fabricated as a subassembly and shipped to the packager without the valve or basket falling out of the closure. This saves shipping costs and handling costs at the packager. When it is desired to dispense product, body 24 of container 22 is manually squeezed, so that the viscous product within the container applies pressure to the underside of valve 36 through basket collar 60 and the spaces between spokes 62. This pressure moves wall portion 72 of valve 36 upwardly in the orientation of FIGS. 2–3, and opens slit 76 against the resilient forces applied thereto by ribs 80, lugs 78 and wall portion 72. The pressure within container 22 also urges lip 68 of valve 36 against rib 84 on closure base 38, so that a product is dispensed from within the container.

When the container is released following dispensation of product, negative pressure within the container and the force of withdrawing product, coupled with the internal biasing forces of valve 36, return valve 36 to the closed positioned illustrated in the drawings. In the meantime, the negative pressure within container 22 urges valve lip 68 downwardly away from closure rib 84 to provide for venting of the container interior through slots 70 and through-opening 58. Rib 56 within channel 54 of basket 34 prevents lip 68 from sealing against the opposing surface of basket 34, which might otherwise block this venting operation.

What is claimed is:

1. A method of making a valve for a self-sealing dispensing closure that comprises the steps of:

(a) forming a valve element of one-piece integrally molded elastic composition having an annular base, a web portion that extends radially inwardly from said base, a mouth portion that extends axially from an inner periphery of said web portion to a circular opening coaxial with said base, and a diametrically split lip that extends axially inwardly from said surrounding said opening, and (b) axially inverting said web and mouth portions of said valve element such that said split lip forms opposed diametrically extending external ribs that configure said opening as a diametric slit between said ribs, and said web portion is internally stressed to bias said slit closed.

2. The method set forth in claim 1 wherein said step (a) includes forming diametrically opposed lugs on said web portion at 90 degree spacing from the splits in said lip, such that, upon completion of said step (b), internal residual stresses in said lugs bias said slit closed.

3. The method set forth in claim 2 wherein said step (a) includes forming a rib that extends radially outwardly from said base.

4. The method set forth in claim 3 wherein said step (a) further includes forming a peripheral lip that extends radially outwardly from said peripheral rib, said rib and said lip being circumferentially continuous, and said lip being thinner and more flexible than said rib.

5. The method set forth in claim 3 wherein said step (a) is carried out such that said peripheral al rib has at least one radial slot in a sur face thereof remote from said lugs.

6. The method set forth in claim 5 wherein said step (a) is carried out such that a circumferential array of said radial slots are angularly s paced from each other.

7. The method set forth in claim 5 comprising the additional step of: (c) securing said valve in a dispensing closure by (c1) forming a closure base, and (c2) securing said valve element against said closure base following said step (b).

8. The method set forth in claim 7 wherein said step (c) is carried out such that there is a circumferential rib on said closure base that is resiliently engaged by said peripheral lip on said valve element , and said slit on said rib on said valve element opposes said closure base.

9. The method set forth in claim 8 wherein said step (c) comprises the additional steps of: (c3) forming a basket having a central portion and a peripheral portion, and (Co.) securing said peripheral portion of said basket to said closure such that said central portion supports said lugs and said web portion of said valve element.

10. The method set forth in claim 9 wherein said step (c3) i such that said basket has an axial passage that underlies said radial lip following said step (c4).

* * * * *